US007300147B2

(12) United States Patent
Johnson

(10) Patent No.: US 7,300,147 B2
(45) **Date of Patent: *Nov. 27, 2007**

(54) INKJET PRINTING SYSTEM WITH AN INTERMEDIATE TRANSFER MEMBER BETWEEN THE PRINT ENGINE AND PRINT MEDIUM

(75) Inventor: Bruce G. Johnson, Ridgefield, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 628 days.

This patent is subject to a terminal disclaimer.

(21) Appl. No.: 10/616,668

(22) Filed: Jul. 9, 2003

(65) Prior Publication Data

US 2004/0104990 A1 Jun. 3, 2004

Related U.S. Application Data

(63) Continuation of application No. 09/991,314, filed on Nov. 19, 2001, now Pat. No. 6,639,527.

(51) Int. Cl.
*B41J 2/01* (2006.01)

(52) U.S. Cl. ..... 347/103

(58) Field of Classification Search ..... 347/103, 347/102

See application file for complete search history.

(56) References Cited

U.S. PATENT DOCUMENTS 5,365,261 A * 11/1994 Ozawa et al. ..... 347/103
5,723,251 A * 3/1998 Moser ..... 430/126
5,862,753 A * 1/1999 Dolan et al. ..... 101/217
6,354,700 B1 * 3/2002 Roth ..... 347/103
6,639,527 B2 * 10/2003 Johnson ..... 341/104

FOREIGN PATENT DOCUMENTS

EP 530627 A2 * 3/1993
JP 3-284948 * 12/1991

* cited by examiner

*Primary Examiner*—Stephen Meier
*Assistant Examiner*—Ly T. Tran

(57) ABSTRACT

In an inkjet printer, the print head does not print images directly to the print medium. Rather, the print head prints the image to an intermediate transfer member, for example a transfer belt or drum. The transfer member then transfers the image to the print medium to produce the desired hard copy document. By printing to an intermediate transfer member and then transferring the image to the print medium, additional time is provided for the carrier fluid of the ink to evaporate or be absorbed by the transfer member before the image is transferred to the print medium. In this way, less carrier fluid is eventually deposited to the print medium than if the image had been printed directly on the print medium. Consequently, cockle formation is decreased.

22 Claims, 8 Drawing Sheets

INKJET PRINTING SYSTEM WITH AN INTERMEDIATE TRANSFER MEMBER BETWEEN THE PRINT ENGINE AND PRINT MEDIUM

RELATED APPLICATIONS

This application is a Continuation and claims the priority of U.S. patent application Ser. No. 09/991,314, filed Nov. 19, 2001 now U.S. Pat. No. 6,639,527, all of which is herein incorporated by reference in it's entirety and for all purposes.

TECHNICAL FIELD

The present invention relates to the field of hard copy document printing. More particularly, the present invention relates to the field of inkjet printing. The present invention provides a system in which an inkjet print head prints an image to an intermediate transfer member, e.g., a transfer belt or drum, which then transfers the printed image to a sheet of print medium, e.g., paper. The intermediate transfer member may be heated to facilitate the transfer of the printed image.

BACKGROUND

Computers and computer networks are widely used by most all businesses and many individuals to keep records, communicate, produce documents and otherwise manage information. Frequently, the work prepared on a computer is preferably rendered into hard copy form so that it can be stored or sent to another party. For this reason, printers and other printing devices that can render hard copy documents from computer data are critically important.

Inkjet printers are a particularly popular type of printer. In addition to providing a readily affordable printing solution for home or office, inkjet printers have the advantage, among others, of being particularly well suited for color printing.

In an inkjet printer, the image is developed by ejecting ink droplets from the inkjet print head, also called a "pen," onto a sheet of print medium. Paper is the most common form of print medium, but inkjet printers can print on other media such as cardstock, construction paper, vinyl, transparencies, etc. The ink droplets are ejected from the inkjet print head by, for example, a piezoelectric device that squeezes the ink droplet from the print head, or a thermal member that heats the ink until it is forced out of the print head.

Regardless of the precise method used to expel the ink from the inkjet print head, the ink or toner is dissolved in a volatile, liquid carrier. The carrier facilitates the transfer of the ink from the print head to the print medium. However, the carrier must be evaporated or absorbed by the print medium in order to fix the printed image to the print medium.

Unfortunately, the carrier fluid, when it contacts the print medium, causes the print medium to swell or deform. This is particularly true if the carrier fluid is absorbed by the print medium, but also occurs if the carrier fluid is evaporated from the print medium. This localized swelling of the print medium fibers is a phenomenon known as "cockle."

Due to cockle formation, the volume of ink and of carrier fluid deposited on the print medium must be carefully controlled so that the cockle does not render the resulting hard copy document unacceptable. If too much ink is deposited on the print medium, or the ink is deposited too quickly, the resulting cockle will likely render the appearance of the printed document unacceptable to the printer user.

Prior art solutions to the cockle problem have involved heating the print medium or print zone before, during and/or after the printing in an attempt to dry the ink and evaporate the carrier fluid before cockle formation. However, it is difficult to supply enough heat to dry the ink quickly enough to prevent cockle formation without causing thermal damage to the print medium. This approach becomes even more difficult as the demand occurs for faster printer and higher output rates. With the print medium moving more quickly to increase output, it becomes that much more difficult to adequately dry a printed sheet to prevent cockle formation. The length of the heating zone can be increased to compensate for the faster print speed, but this causes additional expense and difficulty in manufacturing the printer. Moreover, the amount of heat that can be applied is ultimately limited to a temperature that will not damage the print medium.

Consequently, there is a need in the art for a method and system of preventing cockle formation in an inkjet printer.

SUMMARY

The present invention may be directed to an inkjet printing system having an inkjet print head and a transfer member. The inkjet print head prints images on the transfer member. The transfer member then transfers the printed image to a sheet of print medium. The transfer member may be, for example, a transfer belt or drum. The transfer member may also be heated to facilitate the transfer of the printed image.

The system of the present invention may also include a cleaning roller for cleaning the transfer member and a pinch roller for facilitating transfer of an image from the transfer member to the sheet of print medium.

The present invention also encompasses the methods of making and operating a system such as then described above. For example, the present invention encompasses a method of printing with an inkjet printing system by printing an image with an inkjet print head on a transfer member; and transferring the printed image from the transfer member to a sheet of print medium. The method may also include heating the transfer member to facilitate transfer of the printed image.

BRIEF DESCRIPTION OF THE DRAWINGS

The accompanying drawings illustrate preferred embodiments of the present invention and are a part of the specification. Together with the following description, the drawings demonstrate and explain the principles of the present invention.

Throughout the drawings, identical elements are designated by identical reference numbers.

DETAILED DESCRIPTION OF THE PREFERRED EMBODIMENTS

In inkjet printers according to the principles of the present invention, the print head does not print images directly to the print medium. Rather, the print head prints the image to a transfer member, for example a transfer belt or drum. The transfer member then transfers the image to the print medium to produce the desired hard copy document. By printing to an intermediate transfer member and then transferring the image to the print medium, additional time is provided for the carrier fluid of the ink to evaporate or be absorbed by the transfer member before the image is transferred to the print medium. In this way, less carrier fluid is eventually deposited to the print medium than if the image had been printed directly on the print medium. Consequently, cockle formation is decreased.

Using the drawings, the preferred embodiments of the present invention will now be explained.

Figure 1:
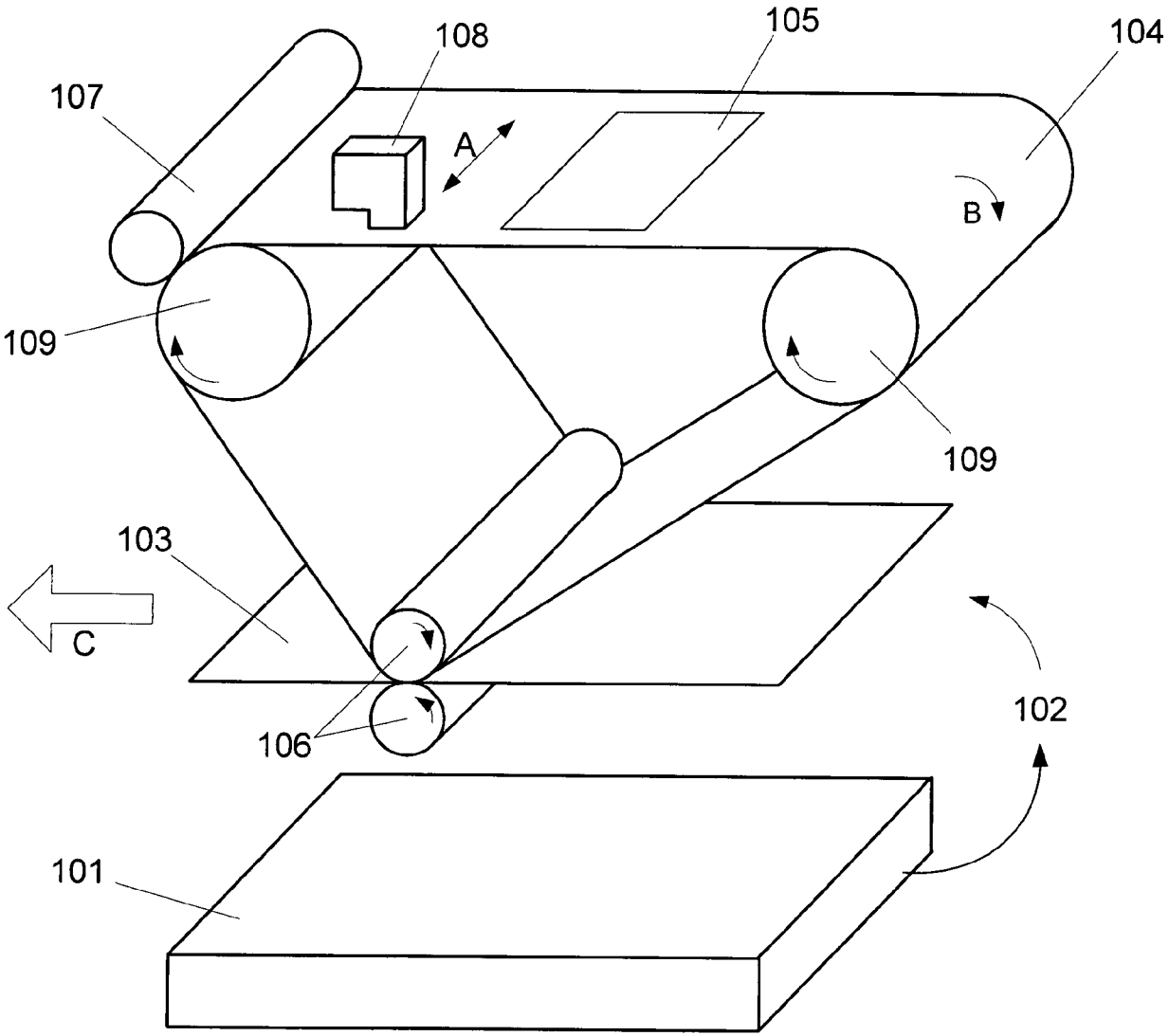
FIG. 1 is an illustration of a preferred embodiment of an inkjet printing system according to the present invention in which an image is initially printed on a transfer belt before being transferred to the print medium.

FIG. 1 illustrates a first preferred embodiment of the present invention. FIG. 1 illustrates an inkjet printing system in which the print head prints images to a transfer belt which then transfers the image to the print medium.

As shown in FIG. 1, a transfer belt (104) is stretched between two upper rollers (109) and runs between two lower rollers (106). This belt (104) is used to receive an image printed by the print head (108) and then transfer that image to the final print medium (103).

On the upper portion of the belt (104) stretched between the two upper rollers (109), an inkjet print head or pen (108) moves back and forth across the belt (104) as indicated by arrow "A." As the print head (108) moves back and forth across the belt (104), droplets of ink are ejected and deposited on the belt (104) to form an image (105). The belt (104) advances with each pass of the print head (108) to allow a subsequent line of the image (105) to be printed by the print head (108). The print head (108) may be printing in color or gray scale depending on the print and user preferences.

When the image (105) has been printed on the belt (104), the belt (104) advances in the direction shown by arrow "B." When the portion of the belt (104) on which the image (105) has been printed reaches the paired rollers (106), the image (105) is transferred to a sheet of print medium (103).

A supply of print medium (101) is provided in the printer or printing device. This supply (101) may be, for example, a tray containing a stack of print medium or, alternatively, may simply be a stack of print medium held in a supply bay in the printer or printing device. As noted above, the print medium (103) can be any print medium on which a printer can print a hard copy document. For example, the print medium (103) may be paper, cardstock, construction paper, transparency, vinyl, adhesive labels and the like.

When an image (105) is to be printed and is deposited on the transfer belt (104), a print medium handling system (not shown) will pull a sheet of print medium (103) from the supply (101). The sheet (103) is then moved through a transport path (102) that passes the sheet (103) between the paired rollers (106).

The advance of the belt (104) and the transportation of the print medium sheet (103) are correlated so that the portion of the belt on which the image (105) is printed and the sheet of print medium (103) pass between the rollers (106) at the same time. At this point, as the belt (104) and print medium (103) are in physical contact, the image (105) is transferred from the belt (104) to the sheet of print medium (103). The paired rollers (106) may be pinch rollers that apply pressure to the belt (104) and print medium (103) to facilitate the transfer of the image (105) from belt (104) to print medium (103).

The print medium (103), which is now a hard copy document bearing the image (105), is output by the printer along a transport path (C). The portion of the endless belt (104) that had carried the image (105) continues around to return to a position under the inkjet print head (108). Before being returned to the print head (108), however, the belt (104) passes between one of the upper rollers (109) and cleaning roller (107). The cleaning roller (107) removes any residual ink and cleans the belt (104) so that the print head (108) can print a new image to the belt (104) for transfer to the print medium (103).

By printing to the transfer belt (104) first and then transferring the image (105) to the print medium (103), additional time is provided during which the carrier fluid of the ink deposited by the print head (108) can evaporate. Consequently, when the image (105) is transferred to the print medium (103), less carrier fluid remains than if the image had been printed directly to the print medium (103). Consequently, cockle formation is decreased.

Typically, the interior of a printer is naturally heated by the operation of the mechanical and electrical components of the printer. This elevated temperature can contribute to evaporation of the carrier fluid from the belt (104). Additionally, the belt (104) may be of a material that will, to some extent, absorb carrier fluid so that less carrier fluid is transferred to the print medium (103).

For all these reasons, by printing the image (105) to the belt (104) before transferring the image (105) to the print medium (103), the amount of carrier fluid deposited on the print medium (103) is decreased and resulting cockle formation is also thereby decreased.

Figure 2:
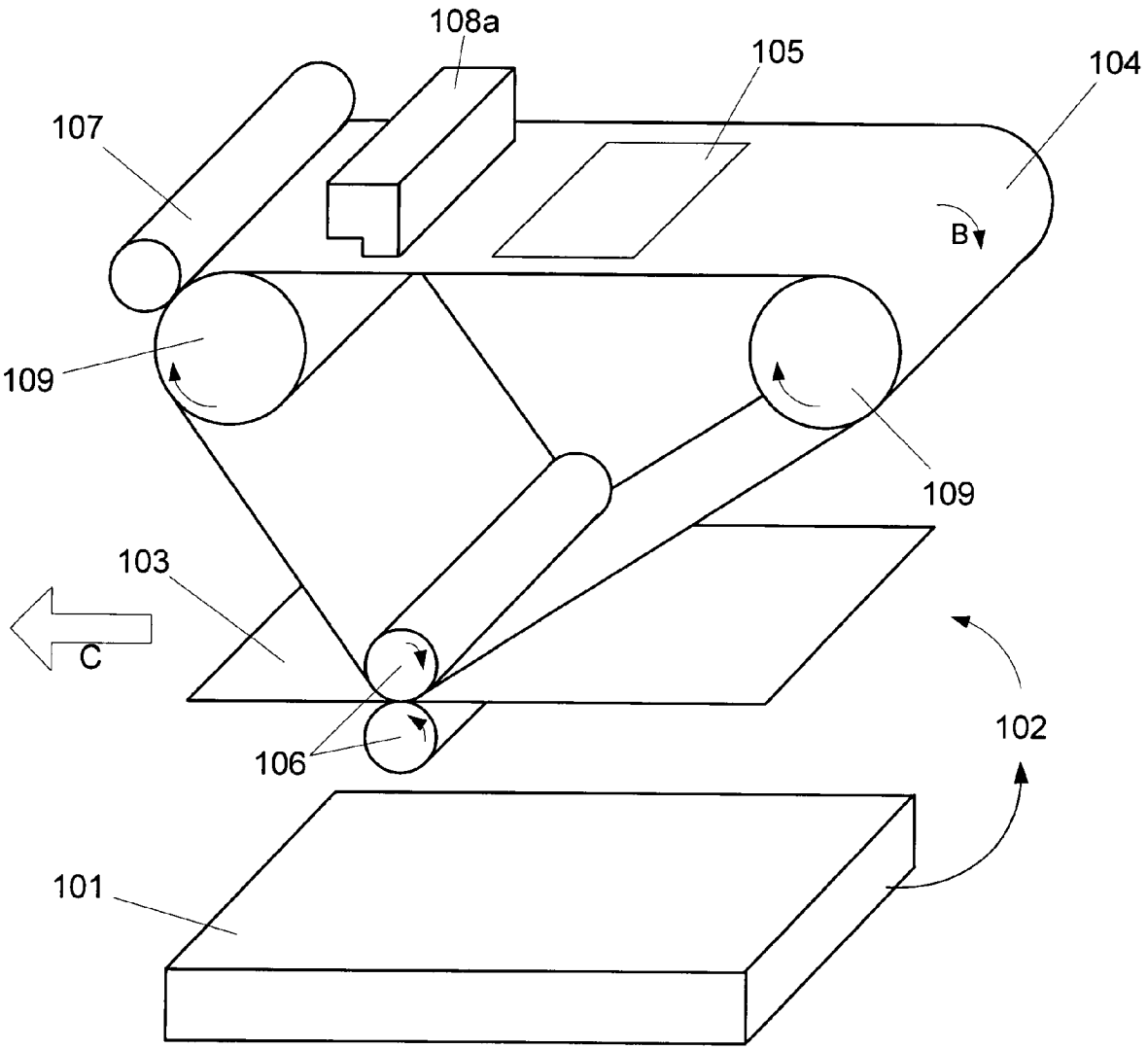
FIG. 2 is an illustration of another preferred embodiment of the inkjet printing system of FIG. 1 with a page-width print head.

FIG. 2 illustrates a second preferred embodiment of the present invention. The embodiment of FIG. 2 is substantially similar to that of FIG. 1 and a redundant explanation of identical components and their operation will be omitted.

FIG. 2 illustrates an inkjet printing system in which the print head or pen (108*a*) does not move back and forth across the transfer belt (104) as does the print head (108) in FIG. 1. Rather, the print head (108*a*) in FIG. 2 is a full-page-width array that prints a complete line of the image (105) simultaneously. The belt (104) then advances, or advances continuously at a rate coordinated with the action of the print head, so that the print head (108*a*) can print the next line of the image (105).

Full-page-width printing arrays obviously contribute to printing speed, but require more complicated components and print data transmission. However, the present invention can be embodied in a full-page-width printing device as illustrated in FIG. 2. Full-page-width printing may be particularly economical in some applications where the width of the print medium being printed is relatively small.

Additionally, multiple page width arrays (e.g., 108*a*) can be used to increase the print speed. For example, in a color printing system, each array of a set of page width arrays may be dedicated to printing a specific color or set of colors.

Figure 3:
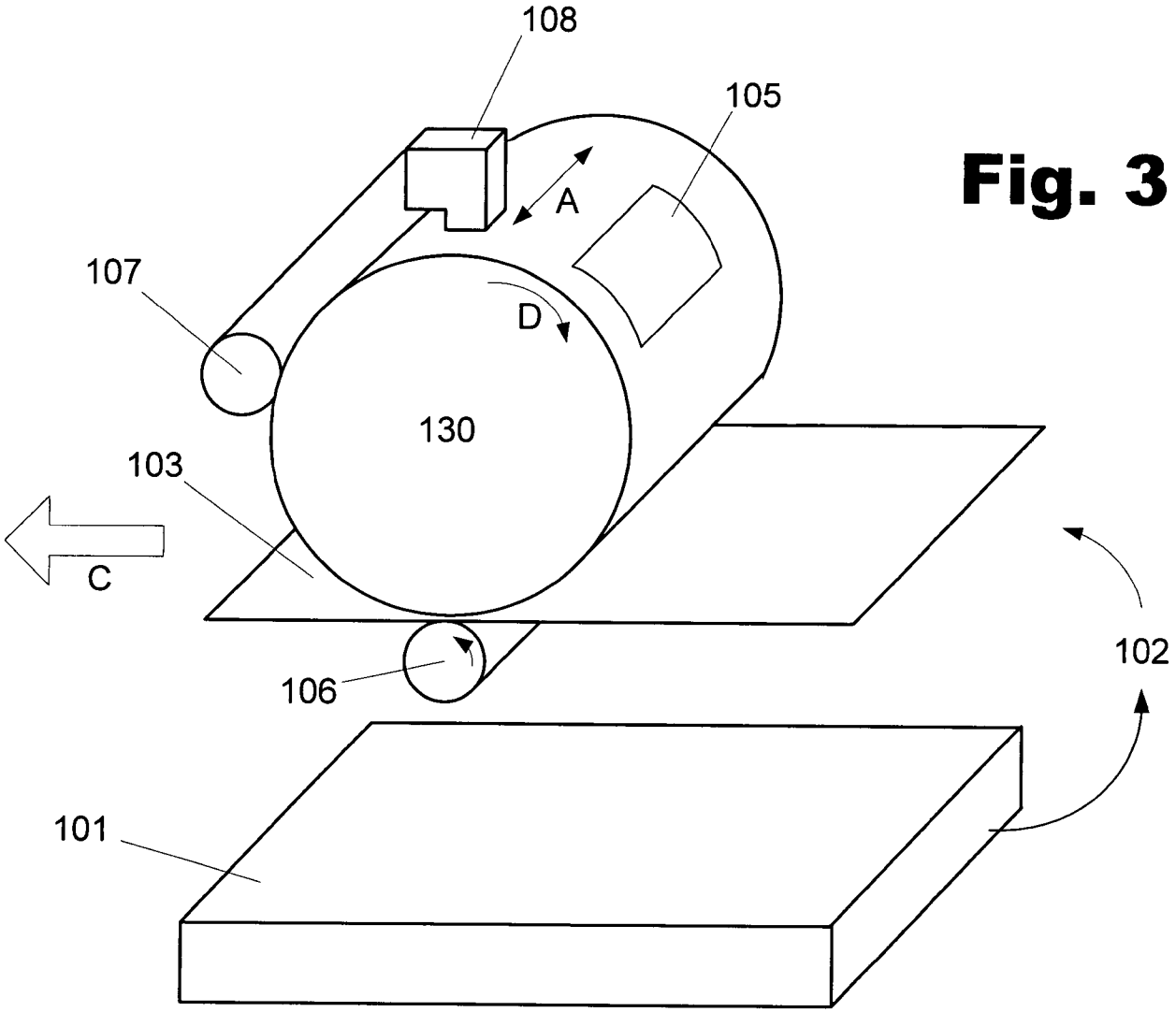
FIG. 3 is an illustration of another preferred embodiment of an inkjet printing system according to the present invention in which an image is initially printed on a transfer drum before being transferred to the print medium.

FIG. 3 illustrates a third preferred embodiment of the present invention. FIG. 3 illustrates an inkjet printing system in which the print head prints images to a transfer drum which then transfers the image to the print medium.

As shown in FIG. 3, a transfer drum (130) rotates between the inkjet print head (108) and a transport path (102) for a sheet of print medium (103). As will be explained in more detail below, this drum (130) is used to receive an image printed by the print head (108) and then transfer that image (105) to the final print medium (103).

On the upper portion of the drum (130), an inkjet print head or pen (108) moves back and forth across the drum (130) as indicated by arrow "A." As the print head (108) moves back and forth across the drum (130), droplets of ink are ejected and deposited on the drum (130) to form an image (105). The drum (130) advances with each pass of the print head (108) to allow a subsequent line of the image (105) to be printed by the print head (108). The print head (108) may be printing in color or gray scale depending on the print and user preferences.

When the image (105) has been printed on the drum (130), the drum (130) advances in the direction shown by arrow "D." When the portion of the drum (130) on which the image (105) has been printed reaches the roller (106), the image (105) is transferred to a sheet of print medium (103).

A supply of print medium (101) is provided in the printer or printing device. As before, this supply (101) may be, for example, a tray containing a stack of print medium or, alternatively, may simply be a stack of print medium held in a supply bay in the printer or printing device. As noted above, the print medium (103) can be any print medium on which a printer can print a hard copy document.

When an image (105) is to be printed and is deposited on the transfer drum (130), a print medium handling system (not shown) will pull a sheet of print medium (103) from the supply (101). The sheet (103) is then moved through a transport path (102) that passes the sheet (103) between the transfer drum (130) and the roller (106).

The advance of the drum (130) and the transportation of the print medium sheet (103) are correlated so that the portion of the drum (130) on which the image (105) is printed and the sheet of print medium (103) come into physical contact at the roller (106). At this point, as the drum (130) and print medium (103) are in physical contact, the image (105) is transferred from the drum (130) to the sheet of print medium (103). The pinch roller (106) may apply pressure to the drum (130) and print medium (103) to facilitate the transfer of the image (105) from drum (130) to print medium (103).

The print medium (103), which is now a hard copy document bearing the image (105), is output by the printer along a transport path (C). The portion of the drum (130) that had carried the image (105) continues around to return to a position under the inkjet print head (108). Before being returned to the print head (108), however, the portion of the drum (130) on which the image (105) was printed is cleaned by a cleaning roller (107). The cleaning roller (107) removes any residual ink and cleans the drum (130) so that the print head (108) can print a new image to the drum (130) for transfer to the print medium (103).

By printing to the transfer drum (130) first and then transferring the image (105) to the print medium (103), additional time is provided during which the carrier fluid of the ink deposited by the print head (108) can evaporate. Consequently, when the image (105) is transferred to the print medium (103), less carrier fluid remains than if the image had been printed directly to the print medium (103). Consequently, cockle formation is decreased.

Typically, the interior of a printer is naturally heated by the operation of the mechanical and electrical components of the printer. This elevated temperature can contribute to evaporation of the carrier fluid from the drum (130). For these reasons, by printing the image (105) to the drum (130) before transferring the image (105) to the print medium (103), the amount of carrier fluid deposited on the print medium (103) is decreased and resulting cockle formation is also thereby decreased.

Figure 4:
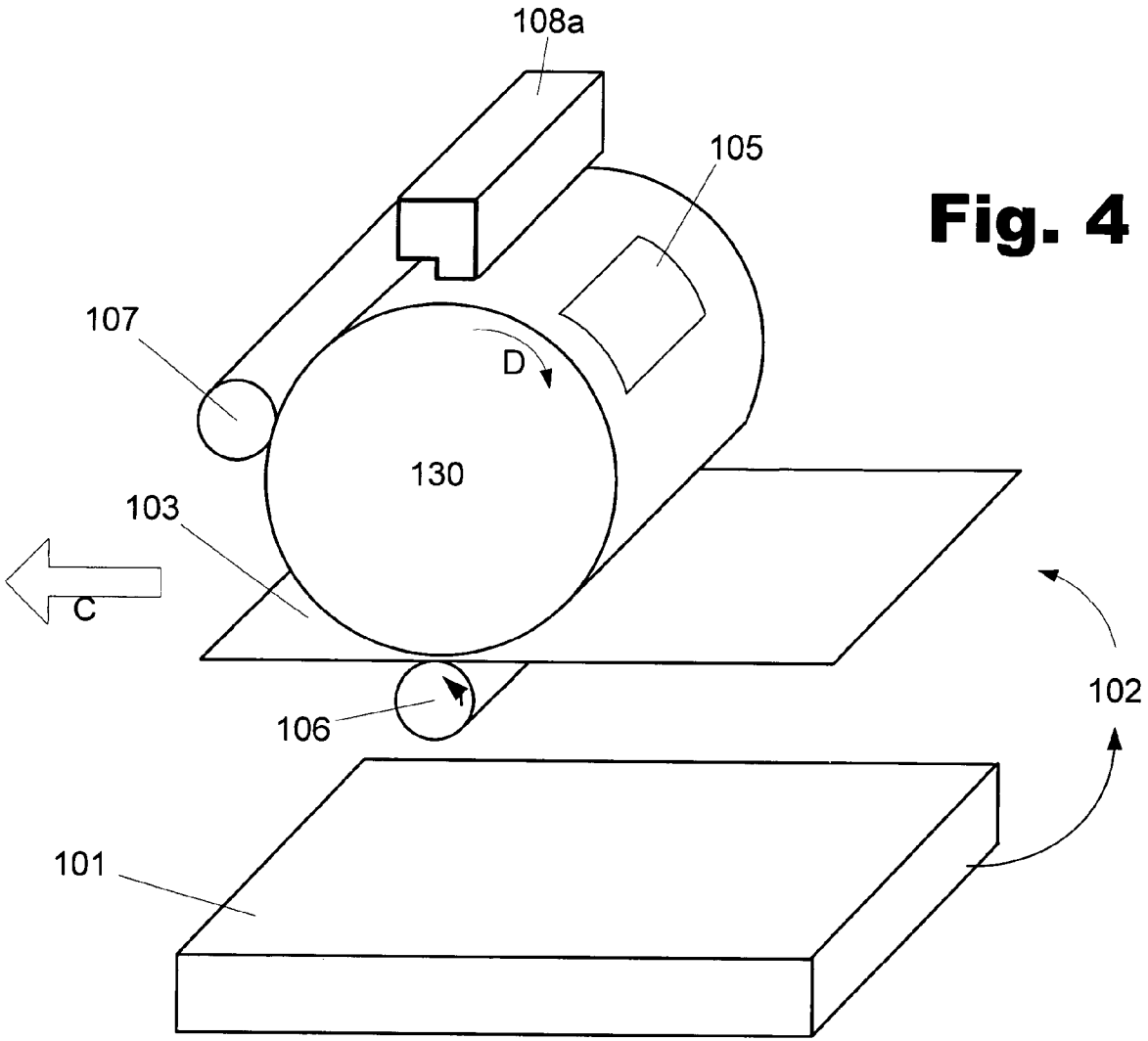
FIG. 4 is an illustration of another preferred embodiment of the inkjet printing system of FIG. 3 with a page-width print head.

FIG. 4 illustrates a fourth preferred embodiment of the present invention. The embodiment of FIG. 4 is substantially similar to that of FIG. 3 and a redundant explanation of identical components and their operation will be omitted.

FIG. 4 illustrates an inkjet printing system in which the print head or pen (108*a*) does not move back and forth across the transfer drum (130) as does the print head (108) in FIG. 3. Rather, the print head (108*a*) in FIG. 4 is a full-page-width array that prints a complete line of the image (105) simultaneously. The drum (130) then advances, or advances continuously at a rate coordinated with the action of the print head, so that the print head (108*a*) can print the next line of the image (105).

Full-page-width printing arrays obviously contribute to printing speed, but require more complicated components and print data transmission. However, the present invention can be embodied in a full-page-width printing device as illustrated in FIG. 4. Full-page-width printing may be particularly economical in some applications where the width of the print medium being printed is relatively small.

Additionally, multiple page width arrays (e.g., 108*a*) can be used to increase the print speed. For example, in a color printing system, each array of a set of page width arrays may be dedicated to printing a specific color or set of colors.

Figure 5:
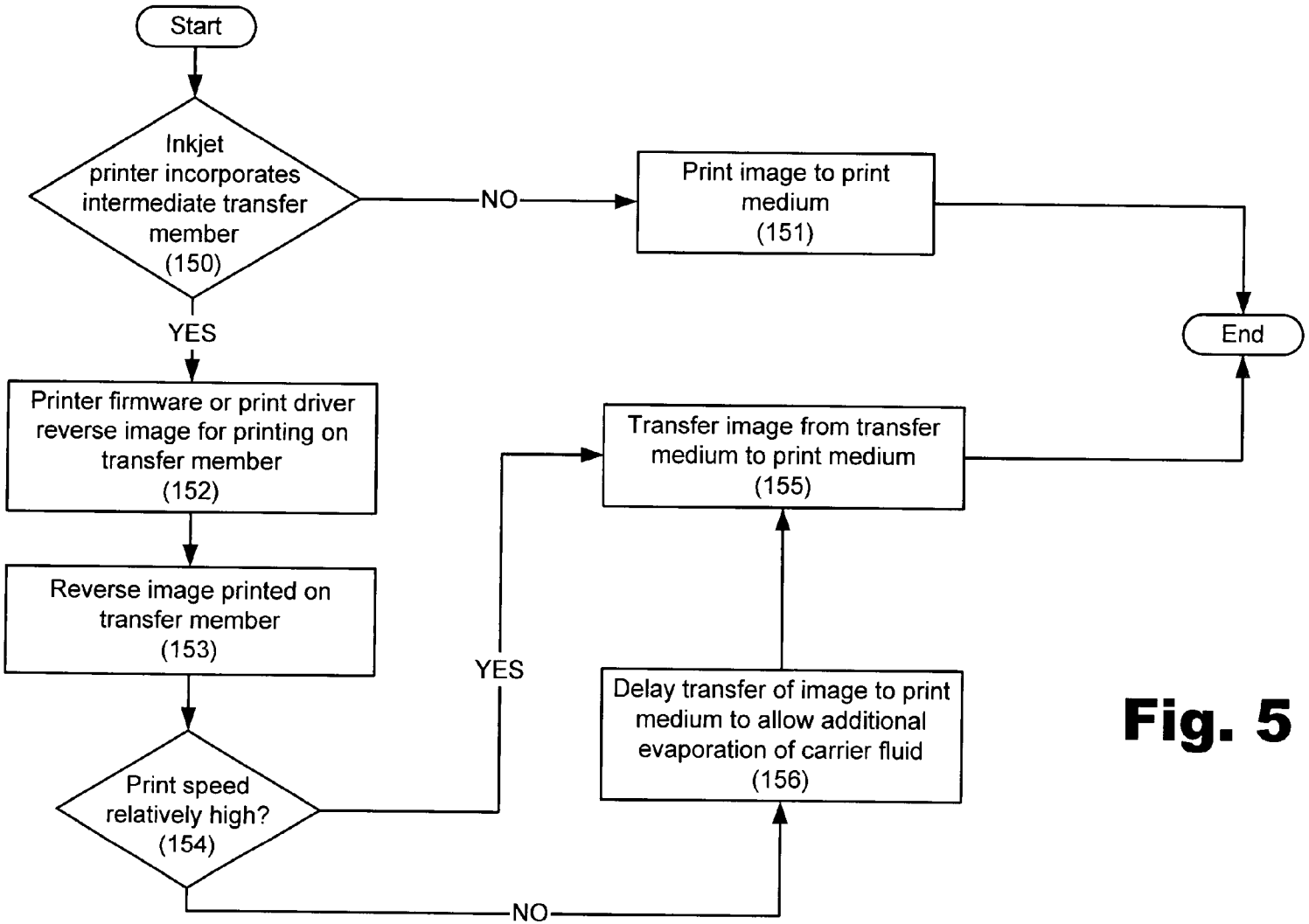
FIG. 5 is a flowchart of a preferred operational method of an inkjet printer according to the principles of the present invention.

FIG. 5 is a flowchart illustrating one possible and preferred method encompassed by the present invention. As shown in FIG. 5, a print job is submitted to an inkjet printer. If the printer is a conventional inkjet printer (150), the print job is simply executed and the image printed to a sheet of print medium (151).

However, if the inkjet printer includes an intermediate transfer member, e.g. a transfer belt or drum, (150), then the printer firmware or printer driver must reverse the image being printed (152). When the image is transferred from the transfer member to the print medium, the image is reversed by the act of the transfer. Consequently, to have the image appear correctly in final form on the print medium, the image must be printed in reverse on the intermediate transfer member. When the image is then transferred to the print medium, it is reversed again and then appears properly.

Next, the reversed image is printed on the transfer member (153). This process, including several possible alternatives, has been described in detail above.

It is advantageous to next consider at what speed the printer has been set to output hard copy documents by default or by user preference. If the output speed setting is relatively high (154), the image printed on the transfer member is quickly transferred to the print medium (155) and output.

However, if the output speed requirement is relatively low, an additional delay can be introduced between the printing of the image on the transfer member and the transfer of the image to the print medium (156). Such a delay obviously facilitates further evaporation of the carrier fluid from the image on the transfer member. Consequently, when the image is transferred to the print medium, less carrier fluid is deposited and cockle formation is minimized.

To achieve the most effective image transfer, the ink could have a charge characteristic. For example, the use of a negative bias charge would assist in the complete transfer of the image.

Figure 6:
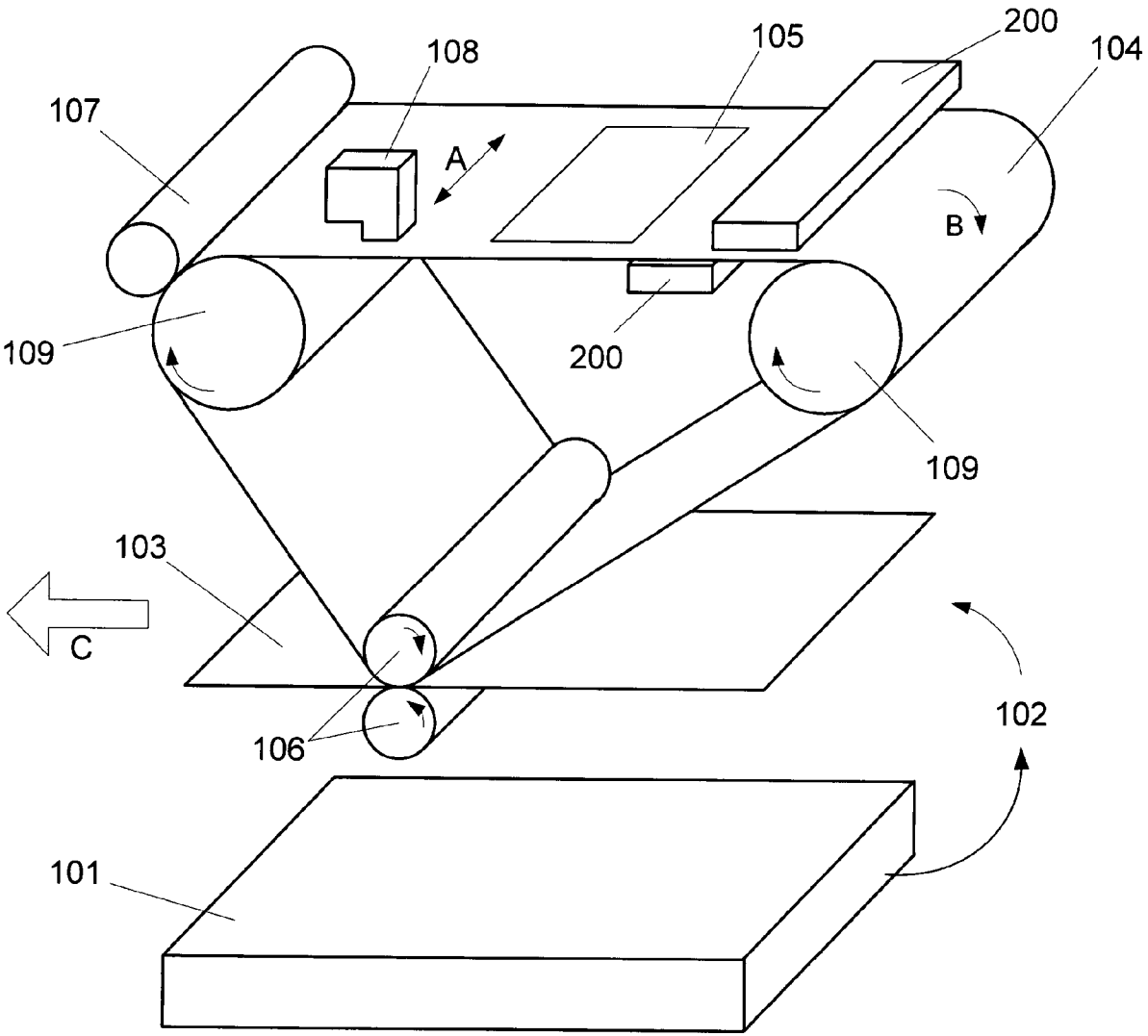
FIG. 6 is an illustration of a preferred embodiment of an inkjet printing system according to the present invention in which an image is initially printed on a heated transfer belt before being transferred to the print medium.

FIG. 6 illustrates a further preferred embodiment of the present invention. FIG. 6 illustrates an inkjet printing system in which the print head prints images to a heated transfer belt which then transfers the image to the print medium. Except for the heated transfer belt, the embodiment of FIG. 6 is substantially similar to that of FIG. 1. Therefore, redundant explanation of components will be minimized.

As shown in FIG. 6, a heated transfer belt (104) is stretched between two upper rollers (109) and runs between two lower rollers (106). As before, this belt (104) is used to receive an image printed by the print head (108) and then transfer that image to the final print medium (103).

On the upper portion of the belt (104) stretched between the two upper rollers (109), an inkjet print head or pen (108) moves back and forth across the belt (104) as indicated by arrow "A" to print an image (105) on the belt (104) as the belt (104) advances.

When the image (105) has been printed on the belt (104), the belt (104) advances in the direction shown by arrow "B." Heating elements (200) are provided along the path of the belt (104) to heat the belt (104) and the print zone. As the printed image (105) passes the heaters (200) and passes through the heated zone, a significant amount of the carrier fluid in the ink of the image (105) will evaporated due to the elevated temperature. The amount of evaporation can be controlled by controlling the speed of the belt (104) passed the heaters (200) and the temperature of the heaters.

After passing through the heated area, the image (105) continues to advance as the belt (104) is advanced. When the portion of the belt (104) on which the image (105) has been printed reaches the paired rollers (106), the image (105) is transferred to a sheet of print medium (103).

By printing to the transfer belt (104) first and then transferring the image (105) to the print medium (103), additional time is provided during which the carrier fluid of the ink deposited by the print head (108) can evaporate. This natural evaporation process is accelerated and can be controlled by the heat applied using the heating elements (200). Consequently, when the image (105) is transferred to the print medium (103), less carrier fluid remains than if the image had been printed directly to the print medium (103). Consequently, cockle formation is controlled. Additionally, the belt (104) may be of a material that will, to some extent, absorb carrier fluid so that less carrier fluid is transferred to the print medium (103).

For all these reasons, by printing the image (105) to the heated belt (104) before transferring the image (105) to the print medium (103), the amount of carrier fluid deposited on the print medium (103) is decreased and resulting cockle formation is also thereby decreased.

As will be apparent to those skilled in the art, a printing system with a heated transfer belt as illustrated in FIG. 6 could be modified to include a page-width printing array such as element (108*a*) in FIG. 2.

Figure 7:
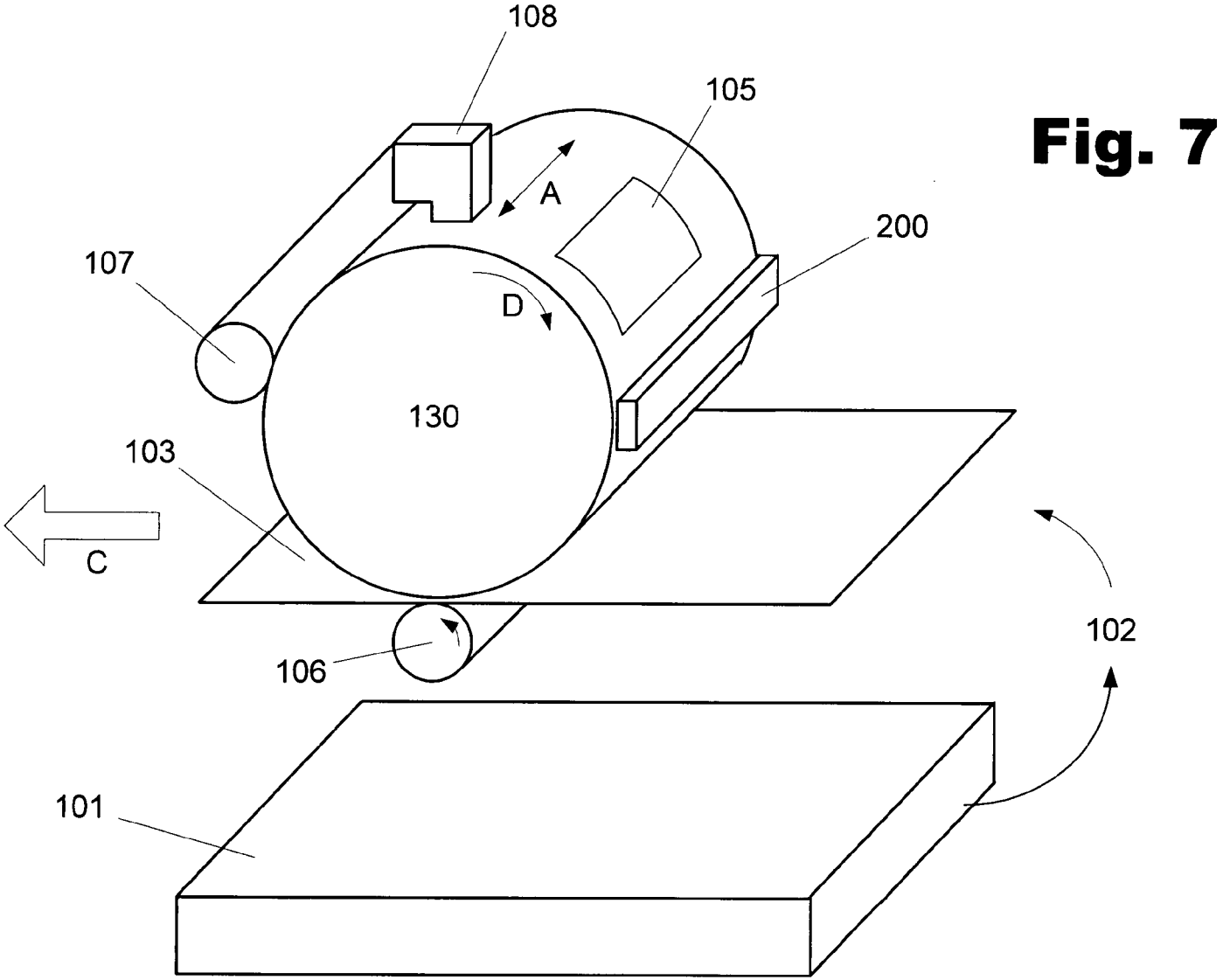
FIG. 7 is an illustration of a preferred embodiment of an inkjet printing system according to the present invention in which an image is initially printed on a heated transfer drum before being transferred to the print medium.

FIG. 7 illustrates a further preferred embodiment of the present invention. FIG. 7 illustrates an inkjet printing system in which the print head prints images to a heated transfer drum which then transfers the image to the print medium. Except for the heated transfer drum, the embodiment of FIG. 7 is substantially similar to that of FIG. 3. Therefore, redundant explanation of components will be minimized.

FIG. 7 illustrates an inkjet printing system in which the print head prints images to a heated transfer drum which then transfers the image to the print medium.

As shown in FIG. 7, a heated transfer drum (130) rotates between the inkjet print head (108) and a transport path (102) for a sheet of print medium (103). As will be explained in more detail below, this drum (130) is used to receive an image printed by the print head (108) and then transfer that image (105) to the final print medium (103).

On the upper portion of the drum (130), an inkjet print head or pen (108) moves back and forth across the drum (130) as indicated by arrow "A" to print an image (105) as the drum advances.

When the image (105) has been printed on the drum (130), the drum (130) advances in the direction shown by arrow "D." This rotation of the drum (130) sweeps the image (105) passed a heating element (200). The heat from this heating element (200) heats the drum (200) and the print zone. As a result, carrier fluid from the ink of the image (105) evaporates due to the elevated temperature. The amount of carrier fluid that evaporates can be controlled by controlling the temperature of the heater (200) and the rotational speed of the drum (130).

The drum continues to rotate to bring the image (105) to a transfer point where the image (105) will be transferred to a sheet of print medium (103). In the example illustrated in FIG. 7, the image (105) is transferred to a sheet of print medium (103) when the portion of the drum (130) on which the image (105) has been printed reaches the roller (106).

By printing to the transfer drum (130) first and then transferring the image (105) to the print medium (103), additional time is provided during which the carrier fluid of the ink deposited by the print head (108) can evaporate. This natural evaporation process is accelerated and can be controlled by the heat applied using the heating element (200). Consequently, when the image (105) is transferred to the print medium (103), less carrier fluid remains than if the image had been printed directly to the print medium (103). Consequently, cockle formation is controlled.

As will be apparent to those skilled in the art, a printing system with a heated transfer drum as illustrated in FIG. 7 could be modified to include a page-width printing array such as element (108*a*) in FIG. 4.

Figure 8:
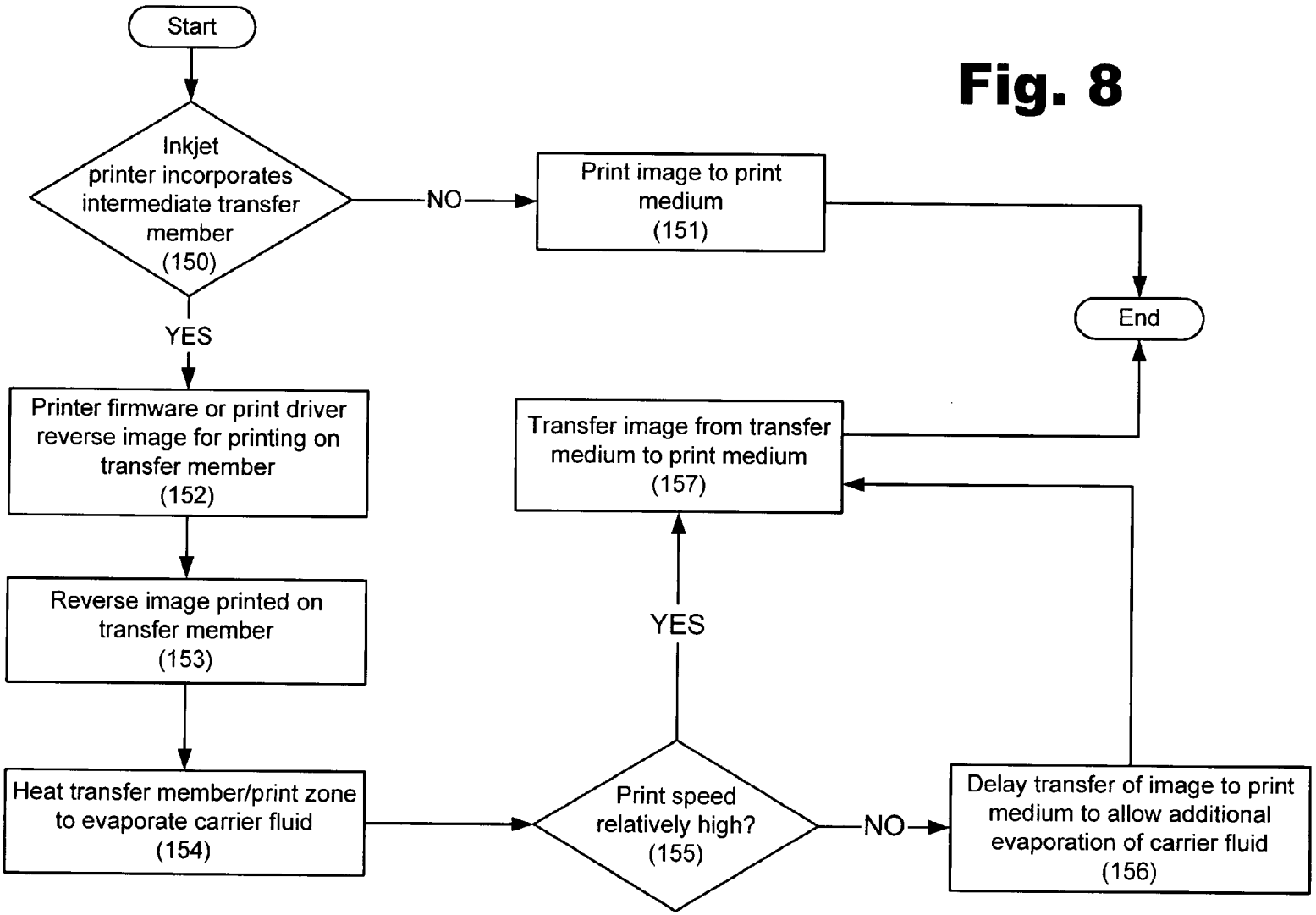
FIG. 8 is a flowchart of a preferred operational method of an inkjet printer with a heated transfer member according to the principles of the present invention.

FIG. 8 is a flowchart illustrating one possible and preferred method encompassed by the present invention. As shown in FIG. 8, a print job is submitted to an inkjet printer. If the printer is a conventional inkjet printer (150), the print job is simply executed and the image printed to a sheet of print medium (151).

However, if the inkjet printer includes a heated transfer member, e.g. a transfer belt or drum, (150), then the printer firmware or printer driver must reverse the image being printed (152). When the image is transferred from the transfer member to the print medium, the image is reversed by the act of the transfer. Consequently, to have the image appear correctly in final form on the print medium, the image must be printed in reverse on the transfer member.

When the image is transferred to the print medium, it is reversed again and then appears correctly.

Next, the reversed image is printed on the intermediate transfer member (153). This process, including several possible alternatives, has been described in detail above. Then, the image on the transfer member is exposed to heat to evaporate the carrier fluid in the ink of the image (154).

It is advantageous to next consider at what speed the printer has been set to output hard copy documents by default or by user preference. If the output speed setting is relatively high (155), the image printed on the transfer member should be quickly transferred to the print medium (157) and output.

However, if the output speed requirement is relatively low, the movement of the transfer member, i.e., the belt or drum, can be slowed and controlled to provide optimal evaporation of the carrier fluid under the influence of the heater that is heating the print zone and transfer member (156). Consequently, when the image is transferred to the print medium, less carrier fluid is deposited and cockle formation is minimized.

To achieve the most effective image transfer, the ink could have a charge characteristic. For example, the use of a negative bias charge would assist in the complete transfer of the image.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A method of printing with an inkjet printing system, said method comprising:

providing a supply of liquid ink comprising a carrier fluid;

using said ink, printing an image with an inkjet print head on a transfer belt that is adjacent to said print head and moveable with respect to said print head;

absorbing carrier fluid from ink of said image with said transfer belt;

heating said transfer belt to facilitate removal of said carrier fluid from said image on said transfer belt; and transferring said printed image from said transfer belt to a sheet of print medium.

2. The method of claim 1, wherein said printing an image further comprises moving said inkjet print head with respect to said transfer member.

3. The method of claim 1, wherein said printing an image further comprises printing a line of said image at a time, said inkjet print head being a page-width array.

4. The method of claim 1, further comprising cleaning said transfer member after transfer of said image to said sheet of print medium.

5. The method of claim 1, further comprising facilitating transfer of an image from said transfer member to said sheet of print medium with a pinch roller.

6. The method of claim 1, further comprising delaying transfer of said image from said transfer member to said sheet of print medium to allow evaporation of carrier fluid from ink of said image.

7. The method of claim 1, further comprising providing said supply of liquid ink comprising a carrier fluid with an electrical charge, wherein said electrical charge facilitates transfer of said images to the print medium.

8. The method of claim 7, wherein said ink has said electrical charge when ejected from said inkjet print head.

9. The method of claim 1, wherein said method does not include applying a charge to a surface of said carrier fluid on said transfer member.

10. An inkjet printing system comprising:

ink comprising a carrier fluid and having an electrical charge;

an inkjet print head using said ink for printing images on a transfer member that is adjacent to said print head and moveable with respect to said print head; and said transfer member disposed to transfer said images to a print medium;

wherein said electrical charge facilitates transfer of said images to the print medium.

11. The system of claim 10, wherein said transfer member comprises a transfer belt.

12. The system of claim 10, wherein said transfer member comprises a drum.

13. The system of claim 10, wherein said inkjet print head is moveable with respect to said transfer member.

14. The system of claim 10, further comprising a cleaning roller for cleaning said transfer member.

15. The system of claim 10, further comprising a pinch roller for facilitating transfer of an image from said transfer member to said sheet of print medium.

16. The system of claim 10, further comprising at least one heating element for heating said transfer member.

17. A method of printing with an inkjet printing system, said method comprising:

printing an image with an inkjet print head on a transfer member that is adjacent to said print head and moveable with respect to said print head;

moving said transfer member so as to move said image from said print head to a transfer position at which said image is transferred from said transfer member to a sheet of print medium;

evaporating some of a carrier fluid from said image as said transfer member moves between said inkjet print head and said transfer position;

transferring said image from said transfer member to a sheet of print medium; and adjusting a speed of movement of said transfer member to maximize evaporation of said carrier fluid.

18. The method of claim 17, further comprising providing a transfer belt as said transfer member.

19. The method of claim 18, further comprising absorbing carrier fluid from ink of said image with said transfer belt.

20. The method of claim 17, further comprising providing a drum as said transfer member.

21. The method of claim 17, further comprising cleaning said transfer member after transfer of said image to said sheet of print medium.

22. The method of claim 17, further comprising heating said transfer member.

* * * * *